United States Patent [19]

Skafte et al.

[11] 4,155,609

[45] May 22, 1979

[54] WALL-HUNG CABINET ARRANGEMENT

[75] Inventors: Stanley F. Skafte, Newport Beach; Donald R. Dupras, Alto Loma; Gene Schugart, Palos Verdes Estates, all of Calif.

[73] Assignee: Williams Furnace Company, La Miranda, Calif.

[21] Appl. No.: 831,382

[22] Filed: Sep. 8, 1977

[51] Int. Cl.[2] ..... A47B 46/00; A47B 77/10

[52] U.S. Cl. ..... 312/245; D6/128; D6/178; 108/48; 269/321 CF; 312/314

[58] Field of Search ..... 312/245, 246, 247, 248, 312/314, 313, 317 R, 241; D6/178, 128; 108/48; 269/208, 321 CF

[56] References Cited

U.S. PATENT DOCUMENTS

| | | | |
|---|---|---|---|
| 694,312 | 2/1902 | Barber | 312/314 |
| 923,305 | 6/1909 | Sisbower | 5/27 |
| 1,128,477 | 2/1915 | McKee | 312/310 |
| 1,583,611 | 5/1926 | Seely | 269/208 |
| 1,700,924 | 2/1929 | Cushman | 312/314 |
| 2,089,999 | 8/1937 | Greene | 312/245 |
| 2,587,469 | 2/1952 | Herring | 312/314 |
| 2,755,156 | 7/1956 | Nichols | 312/314 |
| 3,242,882 | 3/1966 | Hoyt | 108/48 |
| 3,748,010 | 7/1973 | Garte | 312/314 |

*Primary Examiner*—Robert L. Wolfe
*Assistant Examiner*—Alexander Grosz
*Attorney, Agent, or Firm*—Alter and Weiss

[57] ABSTRACT

A wall-hung cabinet comprising a body portion fixedly attached to a wall. A door is hingedly mounted to said body portion and equipped to independently store items therein. A foldable work bench extends from the bottom body portion of the cabinet. In one embodiment, the bottom of the cabinet is at approximately table height. In another embodiment the cabinet extends practically to the floor. The top of the cabinet is approximately no higher than the reach of an average person. Thus, the wall-hung cabinet provides an ideal and compact unit for storing and making use of craft and hobby tools and apparatus.

2 Claims, 4 Drawing Figures

WALL-HUNG CABINET ARRANGEMENT

This invention relates to wall-hung furniture items, and more particularly to wall-hung cabinet arrangements. Work areas have always been at a premium in the average residence. This is especially true with the advent of the population tending to move back into the city and taking up residence in apartments and condominiums. In the homes, basement space and garage space afforded more room for craft and hobby areas. However, even in spacious homes people tend to desire to keep work and hobby areas to a minimum. For one thing, a compact work space is more efficient to use for a hobby or creative work since all of the materials necessary for the home hobbyist are then at the hobbyist's fingertips and preclude the necessity of wandering about different areas of the home to obtain tools and equipment.

However, in the past, efficient compact work areas have not been provided. The person working about the home doing carpentry tends to use a work bench area as his work space. The tendency is to hang the necessary tools behind the bench on pegboards, or the like. This is often inconvenient, as it necessitates reaching over the bench to obtain a desired piece of equipment, even when the bench may have paraphenelia or newly painted apparatus stacked thereon. Also, with an open bench used as a work space the tendency is against a really clean area. The average hobbyist has a proclivity for leaving tools and working apparatus on and around the bench.

Wall-hung furniture has been available for some time. However, the combination of wall-hung furniture and an efficient, compact and aesthetic work area has not been provided until now.

When the work area is in an apartment, it is especially necessary to provide means for keeping the work area aesthetically pleasing. Similarly, for marketing purposes, it is essential that any equipment provided to enhance the work area be of a size whereby the impulse purchaser can put the equipment in the family vehicle and immediately take it home. Thus, the work area enhancing equipment should not be a cabinet that is extremely large or long; but instead, should be amenable to being carried in the family vehicle for easy transportation to the home. Also, preferably it should be designed so that it can be efficiently hung on a wall by the apartment dweller without professional assistance.

In the past large cabinets have been provided. The large cabinets have deterred the impulse buyer from completing a purchase. In addition to being too large for transportation in the family vehicle, the extra length of the wall-hung cabinets have also added extra weight and made the complete unit bulky, heavy and almost impossible for the apartment dweller to transport and install without professional assistance.

Also, prior art wall-hung cabinets failed to provide suitably situated work benches to facilitate doing either carpentry work, horticulture work or practising other types of hobbies, while providing the storage space necessary for tools to accomplish the various hobbies or projects.

Accordingly, an object of the present invention is to provide a new and unique compact work area.

A related object of the present invention is to provide a new and unique wall-hung craft storage and work cabinet that is readily transportable and not too bulky to be hung by the owner of the cabinet.

Another object of the present invention is to provide wall-hung cabinet arrangements having a work bench extending normally to the wall to which the cabinet is attached and having a door which opens approximately 180 degrees and provides additional storage space.

Still another object of the present invention is to provide a wall-hung cabinet which is aesthetically pleasing in a closed position and enables efficient usage for the hobbyist or craftsman utilizing the cabinet.

Yet another object of the present invention is to provide a wall-hung combined storage and work area which has electrical lights and outlets and a work bench with adjustable feet to assure that the top surface of the work bench is horizontal.

Still another object of the present invention is to provide wall-hung cabinets of a size which enables the user to reach to the top thereof even though the bottom of the cabinet is removed a distance from the floor equivalent to approximately table height.

Still another object of the present invention is to provide wall-hung cabinets having a foldable table therein so that the table can be folded into the cabinet and the cabinet closed and locked to present an aesthetically pleasing exterior.

A preferred embodiment of the wall-hung storage and work area cabinet has the cabinet base portion mounted to the studs behind the wall. A lockable door opens 180 degrees so that it too is flush against the wall in the open position. The door has sufficient depth to provide storage space on the door for tools used with a work bench that extends normally from the wall behind the base portions of the cabinet. The bench is hingedly mounted at the base unit to fold therein. With the table in the extended position the door storage portion is beside the user of the bench.

Thus, any pegboard hanging on the door is not behind the bench, but is beside the bench table to facilitate reaching the tools both for immediate utilization and for facilitating storage to insure ready clean-up of the work space, and encourage closing the cabinet between chores.

The work cabinet arrangement is small enough to be efficiently carried from the point of purchase, transported in the family vehicle and wall mounted by the purchaser without professional assistance. In one embodiment, the cabinet extends slightly below the table top level and up to, but no higher than, easy reach for normal individuals. For example, that preferred embodiment is two feet wide, six inches deep and approximately four feet high.

An embodiment of the work bench provides a vise arrangement to enable utilization of the work bench for carpentry projects, and the like.

The above mentioned and other features and advantages of the present invention will be best understood when taken in consideration of the following description in conjunction with the attached figures, wherein.

Figure 1:
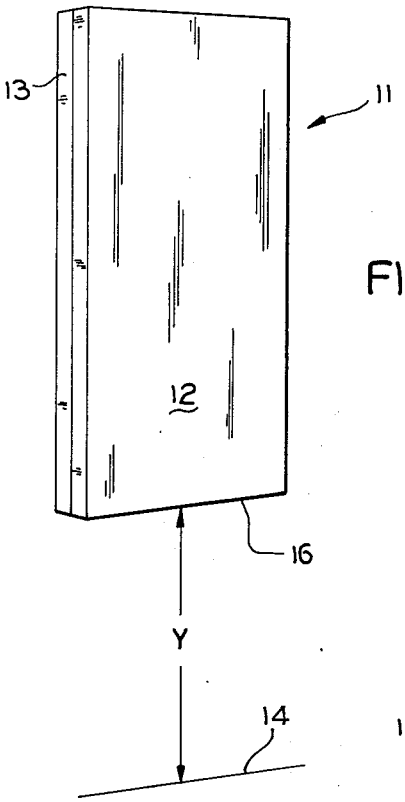
FIG. 1 is a pictorial showing of a smaller version of the wall-hung cabinet in a closed position.

Referring now to the drawings, a shorter version wall-hung storage and work area cabinet 11, is shown generally in FIG. 1 in a closed position. Therein can be seen the door 12 and the base cabinet unit 13 behind the door. It should be noted that the door and base cabinet are shown as having approximately the same depth. It is further noted that the shorter version of the cabinet is suspended on the wall preferably a distance above the floor almost equal to the height of a table top. Thus, the space Y between the floor line 14 and the bottom of the cabinet is less than the height of the normal table. With the longer version, the space approaches zero.

The cabinet when closed and hung on the wall presents a modern aesthetically pleasing view. It is designed to fit almost anywhere in an apartment and blend in with the furniture and general decor. For that matter, it also would fit in with the decor of any home.

Figure 2:
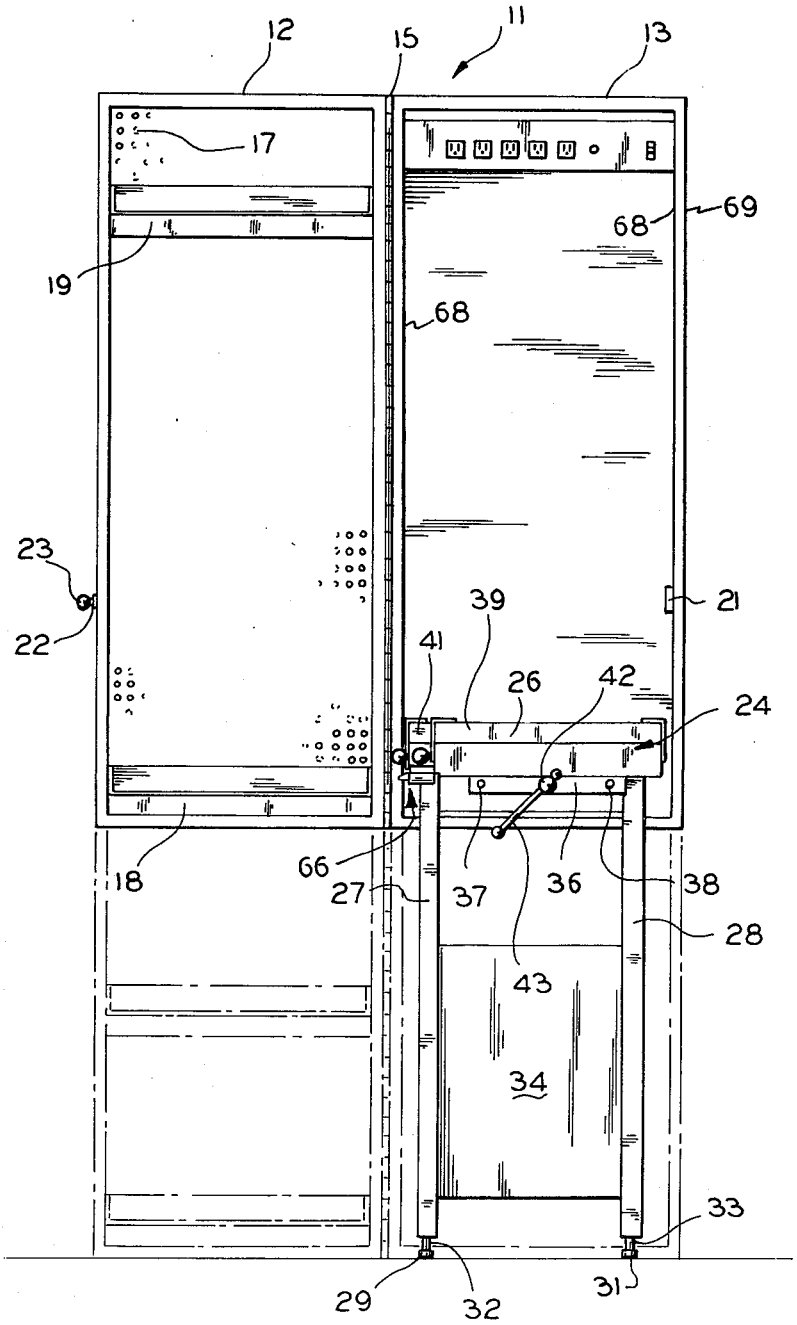
FIG. 2 is a front view of the wall-hung cabinet in the open position with the work bench in the extended position ready for use showing the longer version of the cabinet in dashed lines.

In FIG. 2, the wall-hung cabinet 11 is shown with the door 12 in the open position and the storage portion of the base unit 13 fully exposed. The door 12 is hingedly attached to the base unit 13 with means such as hinge 15. It is seen that preferably in the door 12 there is pegboard 17 designed to receive heavy duty hooks for hanging tools and equipment. There is space at the bottom of the unit for shelving, shown as 18. The space 19 toward the top of the unit can also be used for shelving if desired. The shelving preferably is mounted to the pegboard either with brackets or directly to the pegboard.

Means are provided for locking the cabinet door. This is shown as lock 21 opened by key unit 22. The key 23 shown in unit 22 is removable.

Work bench means are provided which can be folded into the base unit and normally held therein. The work bench unit is shown generally as unit 24. It comprises a horizontal work area 26 and a pa ir of depending legs 27 and 28 extending downward from the work area 26.

Means are provided for adjusting the length of the legs to provide a height allowance in mounting the cabinet and still enable the legs to reach the ground so as to hold the table work area 26 perfectly horizontal. The adjusting means are shown as screw gliders 29 and 31. The legs 27 and 28 have threaded holes at the bottoms thereof to receive the threaded portions 32 and 33 of the gliders 29 and 31.

A skirt 34 extends between the legs 27 and 28 to strengthen the legs and to increase the aesthetic appeal of the open unit. The back of bench unit 24 is mounted directly to the wall studs and thereby aids in mounting the cabinet unit to the wall. The legs 27 and 28 are hinged to the bottom of the table work area so that the legs hang downwardly in the cabinet and against the bottom of the horizontal table work area 26, when the table unit is folded into the cabinet.

The work table 24 may be equipped for various and sundry projects or hobbies. The preferred embodiments shown in FIG. 2 are equipped with a precision vise arrangement.

Figure 3:
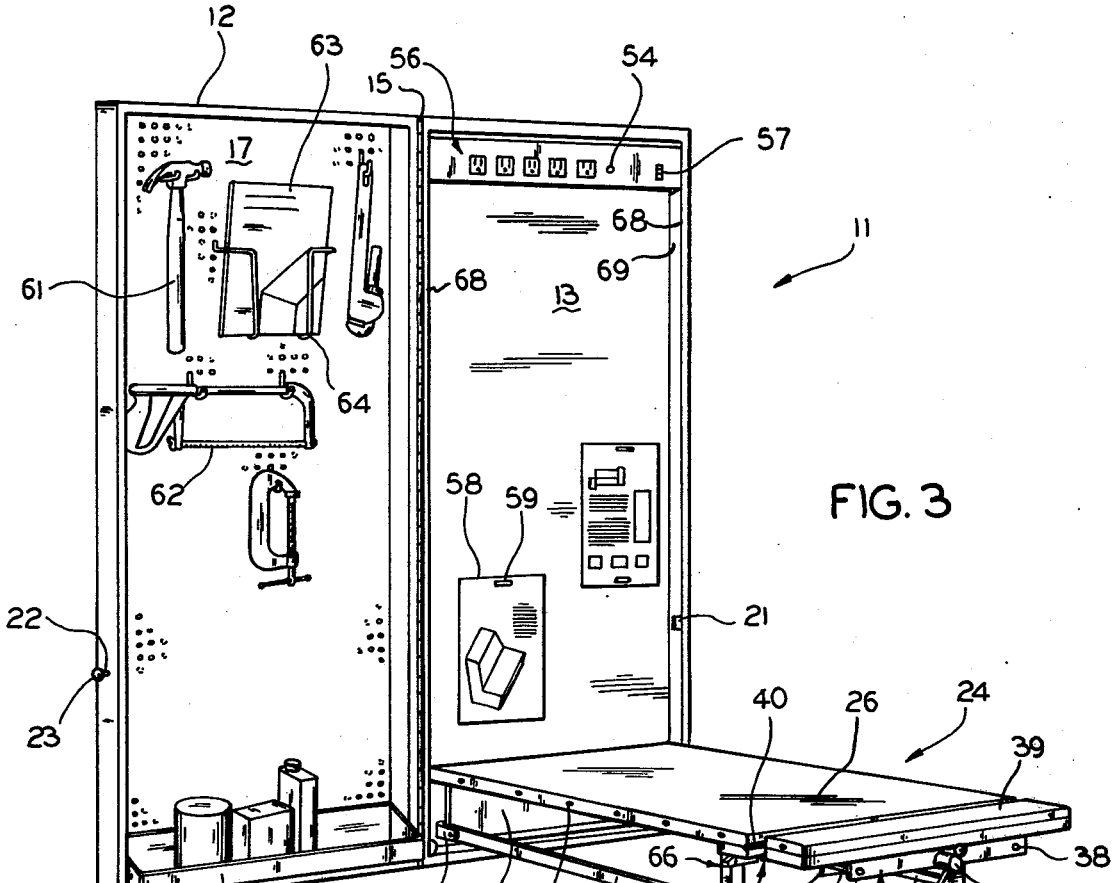
FIG. 3 is a pictorial showing of the wall-hung work space cabinet of FIG. 1 as used with tools and equipment mounted in place and the table in the open position ready for use.

The vise jaws as well as the work table are better seen in the pictorial view of FIG. 3. The work table 24 is shown as comprising the flat work surface 26 supported by the legs 27 and 28. The legs 27 and 28 are reinforced by the skirt 34.

The movable jaw 39 of the vise arrangement is shown spread apart from the fixed end surface 40 of work table 24. The actual screw type control is not shown in this drawing. However, the movable jaw 39, in a preferred embodiment, is selectively movable by the well known screw control operated by lever 43.

The screw lever 43 is shown as mounted into the head of drive screw 46 which in turn is rotatably mounted in channel 36. The channel 36, as seen in FIG. 3, has a front and rear surface **47*a* and 47*b*, parallel to and spaced from a like channel 48. A pair of guide type roos 37 and 38 retain the channels 47 and 48 in parallel alignment to enable rotation of the drive screw 46 with lever 43 to move the movable jaw 39 in and out in relationship to the work table 24 end surface 40. The front channel 36 is fixedly attached to movable jaw 39, while the rear channel 48 is fixedly attached to the bottom of the table surface 26. Thus, as shown, the vise jaw 39** is slightly extended from the table itself.

In the embodiment just described, the clamping capacity of the vise is up to approximately six inches. In order to provide a clamping capacity up to approximately 36" for holding wide boards or for gluing carpentry works, for example, clamping bars are provided.

Figure 4:
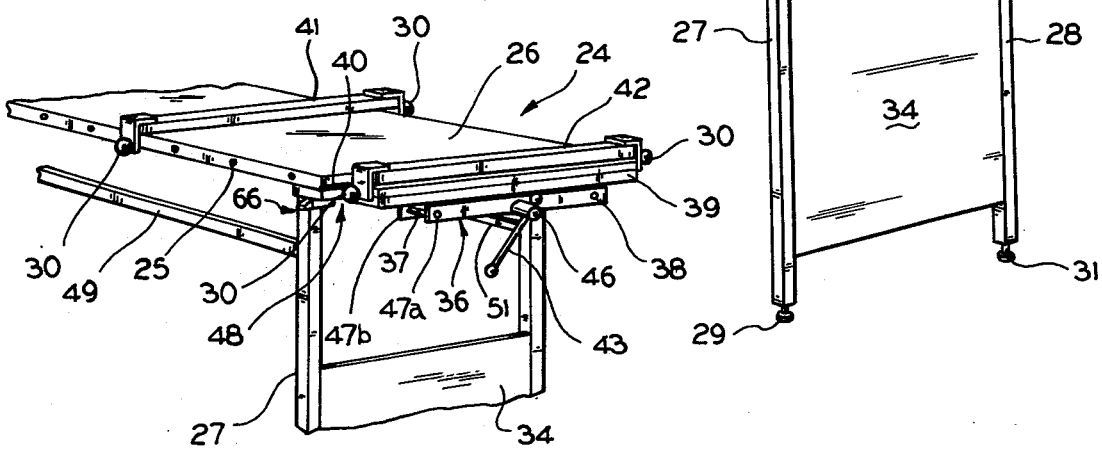
FIG. 4 is a pictorial showing of a partial view of the wall-hung work space cabinet of FIG. 1 with special emphasis on the precision vise arrangement used in conjunction with a work table.

The clamping bars as well as the work table are shown pictorially in FIG. 4. Both side edges of table 24 are provided with mounting holes 25 equally spaced and parallel across from each other. Movable vise jaw 39 also has a mounting hole in each end not shown. Clamping bar 42 is affixed to movable jaw 39 by knob pins 30 through holes provided in each end of clamping bar 42. Clamping bar 41 is fixed to work table 24 by knob pins 30 through a selected pair of holes 25 depending on the width of the work to be clamped. Clamping bar 41 then remains in a fixed relationship to work surface 26. Clamping bar 42, in fixed relationship to movable vise jaw 39, can now be moved in and out by rotating lever 43.

A pair of leg reinforcing and stabilizing angle beams are used for stabilizing the table in the set-up position. More particularly, reinforcing angle beams 49 and 51 are shown extending from brackets mounted to the cabinet base 13. For example, angle beam 49 is pivotally mounted to a bracket 52 and the rear wall of the cabinet base unit 13. The angle beam 51 is similarly pivotally mounted to a bracket. The beams 49 and 51 make a stabilizing parallelogram with surface 26.

Means are provided for hingedly attaching the surface 26 to the rear wall of the base unit 13. The means aren't shown other than the hinge plate 53. The other hinge plate, not shown, is attached to the bottom of the surface 26. Any well known hinge joint attaching means can be used, which provides adequate support for the surface and, preferably, attaches the surface 26 to the wall studs through the rear wall of base 13 and leaves sufficient room between the hinge joint and the rear of base unit 13 to enable the surface 26 to abut the rear wall in the folded up position.

The electrical unit 54 is shown at the top of unit 13. It includes a number of outlets, generally shown as 56, and fluorescent light (not visible in the drawing) as well as switch means 57 for controlling the light.

Plan drawings or general bulletins are conveniently hung on the rear wall. For example, the plan 58 is attached to the rear wall of unit 13 with magnet 59.

The lock portion 21 mounted in the base unit is seen in FIG. 3, as well as the lock and key portion 22 and 23 in the door unit 12.

Also shown is the heavy duty pegboard 17 as well as various tools mounted on the pegboard. For example, the hammer 61 and hacksaw 62 are shown mounted onto the pegboard 17 as well as magazine type publications 63 mounted on the pegboard bracket, such as bracket 64. Only one shelf 18 is shown in the arrangement of FIG. 3. It should be noted that shelf units are readily fixed in different positions as are the tool holding brackets.

Latch means are provided for retaining the work table in the folded position; that is folded into the cabinet base unit 13 so that the door 12 can be closed. More particularly, a latch assembly 66 is provided. The latch assembly 66 is shown affixed to the underside of surface 26 in front of leg 27 of table unit 24. The latch assembly has a bolt which is selectively extended to engage a lip 68 which extends from the side walls, such as wall 69 of base unit 13. The table unit 24 is thus retained in the folded position regardless of whether the door 12 is opened or closed.

The unique wall-hung cabinet is purchased and because of its convenient size can be taken home in the family vehicle. At home it is held at the height desired which is with its bottom at slightly below table-top level. Then it is attached to studs in the wall at convenient places. The lock unit 22 and 21 is unlocked using key 23 and the work table 24 is pulled down with the legs 27 and 28 extending toward the ground. The adjusting screw gliders 29 and 31 are turned until the table surface is level. At this point, the angle beams 49 and 51 extend from their brackets 52 to form a stabilizing parallelogram with the table means. The hobbyist then stands adjacent the table with the door open 180 degrees so that the tools are readily available to him while he works on the table surface 26.

While the principles of the invention have been described above in connection with specific apparatus and applications, it is to be understood that this description is made by way of example only and not as a limitation on the scope of the invention.

What is claimed is:

1. A wall-hung cabinet arrangement providing a compact work area ideally suited for the craftsman and/or hobbyist, said arrangement comprising:

a main body portion having storage space therein suspended from a wall;

door means attached to said main body portion;

storage means on said door means for storing tools and apparatus thereon;

hinge means for attaching said door to said main body portion enabling said door means to selectively pivot at least 180° between a closed position and an open position;

table means including a surface attached to said main body portion, said table means having a first position with said surface parallel to said wall and a second position with said surface horizontal and normal to said wall to provide a horizontal work area for use by the craftsman and/or the hobbyist with the tools and the equipment readily available;

legs extending downward from said horizontal surface for supporting said surface in said second position;

latch means for holding said table means in said first position for storage in said main body portion with said door means in the closed position;

the bottom of said cabinet when mounted on the wall is slightly below the normal table height, the top of said cabinet is within reach of the average person's extended arms, whereby said cabinet is of a length enabling an impulse buyer to put it in his vehicle and take it home, clamp means attached to said table, said clamp means comprising a movable vise jaw attached to the end of the table for holding items between said movable jaw and the end of said table;

a first clamping bar;

means for attaching said first clamping bar to the top of said movable jaw;

a second clamping bar;

means for attaching said second clamping bar to said table at a selected one of a plurality of positions, whereby said jaw can hold items of a wide variety of lengths;

means for hingedly attaching said surface means through said main body portion to wall studs, whereby said table provides a stable, reliable work surface, angle beam means being pivotally attached to each of said legs, said angle beam means being also pivotally attached to said main body section, and said angle beam means being parallel to said surface means when said table is in the extended position and also parallel to each other whereby a stabilizing parallelogram is formed by the main body section, the beams and the surface.

2. A wall-hung cabinet arrangement providing a cabinet work area ideally suited for the craftsman and/or hobbyist, said arrangement comprising a main body portion fixedly attached to a wall and having storage space therein, door means attached to said main body portion, hinge means for attaching said door to said main body portion enabling said door means to selectively pivot 180° between a closed and an open position, storage means in said door means for storing tools and apparatus thereon, table means attached to said main body portion and extendable outwardly therefrom normal to said wall to provide a horizontal surface as a work area for use by the craftsman and/or the hobbyist with the tools and equipment readily available, said table means including legs extending downwardly from said horizontal surface of said table means for supporting said surface, screw type glider means attached to the bottom of said legs for adjusting the length of said legs, latch means attached to said table means for retaining said table folded in said main body portion, said latch means comprising selectively extendable bolt means, lip means surrounding said main body portion, and said extendable bolt means being positioned to be juxtaposed to the inside of said lip means in the extended position thereby retaining said table in the folded position within said main body portion, the bottom of said cabinet when mounted on the wall being slightly below the normal table height and the top of said cabinet being within the reach of the average person's extended arms, clamp means comprising a movable vise jaw attached to the end of the table means for holding items, a first clamping bar, means for attaching said first clamping bar to the top of said movable jaw, a second clamping bar, means for attaching said second clamping bar at a selected one of a plurality of positions on the table whereby items of a wide variety of lengths can be held between said clamping bars, said horizontal surface means being hingedly attached through said main body portion to wall studs, angle beam means pivotally attached to each of said legs, said angle beam means also being pivotally attached to said surface means, said angle beam means being parallel to said surface means, when said table is in the extended position and also being parallel to each other whereby a stabilizing parallelogram is formed by the main body section, the beams and the surface means, said storage means in said door means comprising pegboard means adapted to receive heavy duty pegboard type hooks for use in holding tools and apparatus thereon, electrical fixture and output means attached to said main body portion, and means for holding plans and the like on said main body portion in the light of said fixture adjacent said extended table whereby said user of said arrangement has the tools and apparatus readily available for performing work in accordance with the plans.

* * * * *